US006464370B1

(12) United States Patent
Ulicny

(10) Patent No.: US 6,464,370 B1
(45) Date of Patent: Oct. 15, 2002

(54) DIVING TOOL WITH FLASHLIGHT

(76) Inventor: Thomas Steven Ulicny, 2333 Franklin Ave., Santa Rosa, CA (US) 95403

( * ) Notice: Subject to any disclaimer, the term of this patent is extended or adjusted under 35 U.S.C. 154(b) by 0 days.

(21) Appl. No.: 09/882,916

(22) Filed: Jun. 15, 2001

(51) Int. Cl.[7] ..... B25B 23/18

(52) U.S. Cl. ..... 362/119; 362/109; 362/253; 362/208

(58) Field of Search ..... 362/101, 102, 362/109, 119, 120, 234, 253, 190, 191, 208

(56) References Cited

U.S. PATENT DOCUMENTS 3,370,163 A 2/1968 Brill
4,669,186 A * 6/1987 Liu ..... 362/119
4,751,621 A 6/1988 Jenkins
5,023,761 A * 6/1991 de Lange ..... 362/120
5,033,142 A 7/1991 Templeton
5,313,376 A * 5/1994 McIntosh ..... 362/119
5,964,517 A 10/1999 Adams
5,967,638 A * 10/1999 Gorman et al. ..... 362/109
6,099,138 A 8/2000 Cardan

* cited by examiner

*Primary Examiner*—Stephen Husar
(74) *Attorney, Agent, or Firm*—Jack Lo

(57) ABSTRACT

The present diving tool is comprised of a handle, a threaded lens housing positioned at a front end of the handle and offset to a top side, and a slot positioned at the front end of the handle and offset to a lower side. A battery compartment in the handle behind the lens housing is arranged for receiving a battery. The lens housing is arranged to either activate or deactivate a lamp therein when rotated in opposite directions. An elongated blade is received in the slot of the handle for prying abalone from rocks. The tip of the blade has rounded corners and edges to avoid injuring the abalone. The inner end of the blade has notches on opposite sides which mate with bumps on the sides of the slot to secure the blade.

8 Claims, 1 Drawing Sheet

DIVING TOOL WITH FLASHLIGHT

BACKGROUND OF THE INVENTION

1. Field of the Invention

This invention relates generally to tools with flashlights.

2. Prior Art

An abalone diver must use a tool to pry abalone from rocks on the seafloor. The tool is comprised of an elongated flat blade with a handle. The tip of the blade is required by government regulations to have rounded corners and edges to avoid injuring the abalone in case it is undersized and cannot be harvested. The diver must also carry a flashlight to see the abalone on the dimly lit seafloor. He must hold the abalone tool in one hand and the flashlight in the other hand. Since he has no free hand to grab the abalone when it is dislodged from the rock, he must let go of the tool or flashlight to grab the abalone. After putting the abalone in a container, he must fumble for the tool or flashlight to remove the next abalone. When this process is repeated many times, day after day, the lost productivity can be significant.

Although tools with flashlights are known among the prior art, none is suitable for diving and harvesting abalone. For example, U.S. Pat. No. 6,099,138 to Cardan discloses a search probe comprising a flat plate with hinged sections, a clip attached to the handle of the plate with screws, and a flashlight detachably secured in the clip. However, the hinged plate is not rigid enough for prying loose abalone, and the screw attachment of the clip is relatively inconvenient. Also, the clipped-on flashlight might slip out in rough waters. U.S. Pat. No. 5,964,517 to Adams discloses a barbecue tool comprising a detachable flashlight attached to the handle by straps or latching pins. However, the pressure activated flashlight is prone to inadvertent activation if the tool is handled forcefully or roughly. The flashlight can also shift out of position or even become detached during rough use. Further, the blade of the tool is riveted to the handle, which is relatively labor intensive to assemble.

U.S. Pat. No. 5,033,142 to Templeton discloses a diving tool comprising a tool tip attached to the front of a translucent handle, and a glow stick received in the tube to provide illumination. However, the light emitted from the glow stick is directed to the sides of the handle, not to the tool tip where it is needed. U.S. Pat. No. 4,751,621 to Jenkins discloses a knife with a flashlight built into the handle, but the flashlight is arranged to emit light in the opposite direction from the blade, away from where it is needed. U.S. Pat. No. 3,370,163 to Brill discloses a flashlight with a slot for detachably receiving the handle of a knife. Because the knife is detachable, it is prone to coming loose when handled roughly.

OBJECTIVES OF THE INVENTION

The objectives of the present diving tool with flashlight are:

- to provide a blade for prying loose abalone from rocks on the seafloor;
- to provide a blade which avoids injuring the abalone;
- to provide a flashlight which directs illumination at the tip of the blade;
- to provide a flashlight which is easy to operate but difficult to operate inadvertently;
- to prevent the blade and flashlight from loosening even during rough handling; and
- to have the blade easily assembled with the flashlight.

Further objectives of the present invention will become apparent from a consideration of the drawings and ensuing description.

BRIEF SUMMARY OF THE INVENTION

The present diving tool is comprised of a handle, a threaded lens housing positioned at a front end of the handle and offset to a top side, and a slot positioned at the front end of the handle and offset to a lower side. A battery compartment in the handle behind the lens housing is arranged for receiving a battery. The lens housing is arranged to either activate or deactivate a lamp therein when rotated in opposite directions. An elongated blade is received in the slot of the handle for prying abalone from rocks. The tip of the blade has rounded comers and edges to avoid injuring the abalone. The inner end of the blade has notches on opposite sides which mate with bumps on the sides of the slot to secure the blade.

DRAWING REFERENCE NUMERALS

| | |
|---|---|
| 10. Handle | 11. Lens Housing |
| 12. Threaded Ring | 13. Top Side |
| 14. Slot | 15. Lower Side |
| 16. Lamp | 17. Battery Compartment |
| 18. Battery | 19. First Pole on Lamp |
| 20. First Pole on Battery | 21. Mounting Flange |
| 22. Second Pole on Lamp | 23. Conductor |
| 24. Second Pole on Battery | 25. Blade |
| 26. Thinner Front Portion | 27. Tip |
| 28. Rounded Corners | 29. Rounded Edges |
| 30. Inner End of Slot | 31. Inner End of Blade |
| 32. Notches | 33. Bumps |
| 34. Loop | |

DETAILED DESCRIPTION OF THE INVENTION

Figure 1:
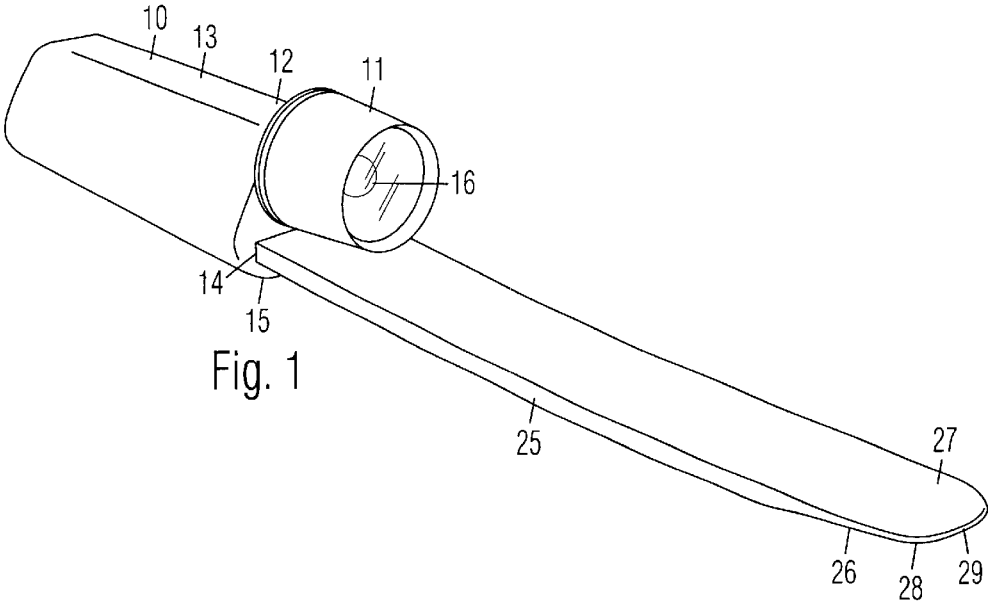
FIG. 1 is a front perspective view of the present diving tool with flashlight.
Figure 2:
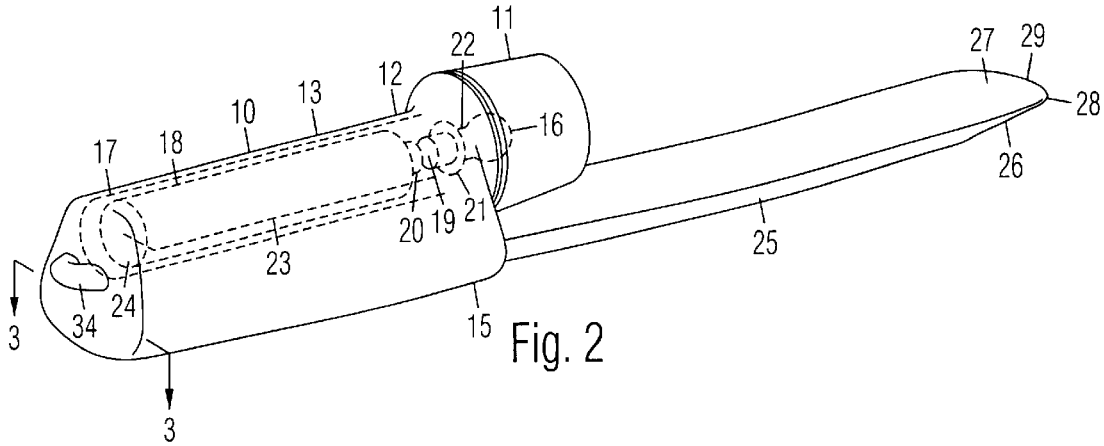
FIG. 2 is a rear perspective view thereof.

A preferred embodiment of the present diving tool is shown in front and rear perspective views in FIGS. 1 and 2. It is comprised of a handle 10, a threaded circular lens housing 11 attached to and rotatable on a threaded ring 12 at a front end of handle 10 and offset toward a top side 13, and a slot 14 positioned at the front end of handle 10 and offset to a lower side 15. A lamp 16 is supported inside lens housing 11 for directing light forward. A battery compartment 17 behind lens housing 11 is arranged for receiving at least one battery 18.

Lens housing 11 is also a switch which is arranged to either activate or deactivate lamp 16 when rotated in opposite directions. For example, a first pole 19 on lamp 16 is in constant contact with a first pole 20 on battery 18. When lens housing 11 is rotated in a first direction to advance a mounting flange 21 connected to a second pole 22 on lamp 16 toward battery 18, flange 21 is pushed into contact with a conductor 23 connected to a second pole 24 on battery 18 to complete the circuit. Alternatively, another arrangement may be provided to complete the circuit, but it is preferably accomplished by rotating lens housing 11. An elongated blade 25 is received in slot 14 of handle 10 for prying abalone or other shellfish from rocks on the seafloor. Blade 25 has a thinner front portion 26 for digging between the abalone and the rock, and a tip 27 with rounded corners 28 and rounded edges 29 to avoid injuring the abalone in case it is undersized and cannot be harvested. A loop 34 is attached to the rear end of handle 11 for being tied to a lanyard.

Lens housing 11 is offset from blade 25 for emitting light in a forward direction generally parallel to blade 11. Lamp 16 is easily activated by rotating lens housing 11. When lamp 16 is activated, light is directed forwards to illuminate tip 27 of blade 25 and any abalone nearby. Since lens housing 11 is positioned forward of handle 11, it would not be touched by the user and operated inadvertently even during forceful or rough use.

Figure 3:
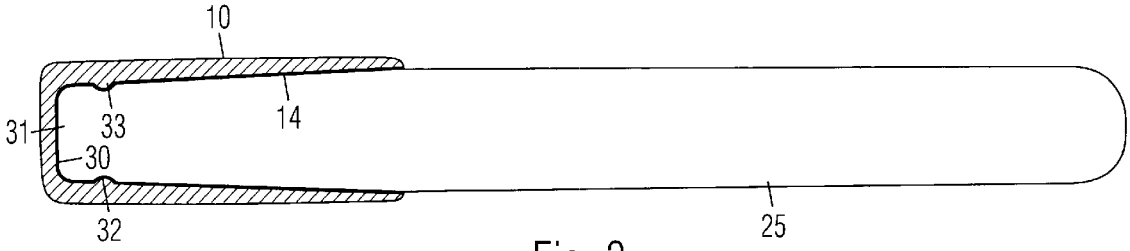
FIG. 3 is a sectional view thereof, taken along line 3—3 in FIG. 2.

As shown in the sectional view in FIG. 3, slot 14 and blade 25 are both tapered toward their respective inner ends 30 and 31. When blade 25 is inserted into slot 14, it is wedged in securely. Blade 25 is thus very easy to assemble with handle 10. Further, inner end 31 of blade 25 has notches 32 on opposite sides which mate with bumps 33 on the sides of slot 14 to lock in blade 25. Alternatively, blade 25 may be cemented or otherwise secured inside slot 14 to prevent it from loosening during rough use.

SUMMARY AND SCOPE

Accordingly, the present diving tool provides a blade for prying loose abalone from rocks on the seafloor. It provides a blade which avoids injuring the abalone. It provides a flashlight which directs illumination at the tip of the blade where it is needed. It provides a flashlight which is easy to activate but difficult to deactivate inadvertently. It prevents the blade and flashlight from loosening even during rough handling. It also provides a blade which is easily assembled with the flashlight.

Although the foregoing description is specific, it should not be considered as a limitation on the scope of the invention, but only as an example of the preferred embodiment. Many variations are possible within the teachings of the invention. For example, different attachment methods, fasteners, materials, dimensions, etc. can be used unless specifically indicated otherwise. The relative positions of the elements can vary, and the shapes of the elements can vary. Therefore, the scope of the invention should be determined by the appended claims and their legal equivalents, not by the examples given.

I claim:

1. A diving tool, comprising:

a handle;

a lens housing attached to a front end of said handle and offset to a top side of said handle;

a slot positioned at said front end of said handle and offset to a lower side of said handle;

a lamp supported inside said lens housing for directing light forward of said handle;

a battery compartment behind said lens housing arranged for receiving at least one battery;

a switch attached to said handle and arranged to activate said lamp; and an elongated blade received in said slot and having a tip projecting forward of said handle for prying shellfish from rocks on a seafloor, wherein said blade has a front portion which is thinner than a rear portion for facilitating digging between said shellfish and said rocks, and said tip is provided with rounded comers and rounded edges for avoiding injuring the shellfish;

wherein when said lamp is activated, light is directed forwards to illuminate said tip of said blade and any shellfish nearby.

2. The diving tool of claim 1, wherein said slot and said blade are tapered toward respective inner ends thereof, and said blade is arranged to be securely wedged inside said handle when fully inserted into said slot.

3. The diving tool of claim 1, further including notches on opposite sides of said inner end of said blade which mate with bumps on opposite sides of said slot to lock in said blade.

4. The diving tool of claim 1, further including a lanyard loop attached to a rear end of said handle.

5. A diving tool, comprising:

a handle;

a threaded ring attached to a front end of said handle and offset toward a top side of said handle;

a threaded circular lens housing attached to and rotatable on said threaded ring;

a slot positioned at said front end of said handle and offset to a lower side of said handle;

a lamp supported inside said lens housing for directing light forward of said handle;

a battery compartment behind said lens housing arranged for receiving at least one battery;

wherein said lens housing is comprised of a switch which is arranged to close a circuit between said lamp and said battery to activate said lamp when rotated in a first direction, and open said circuit to deactivate said lamp when rotated in a second direction, and since said switch is positioned forward of said handle, said switch is arranged to avoid being operated inadvertently; and an elongated blade received in said slot and having a tip projecting forward of said handle for prying shellfish from rocks on a seafloor, wherein said blade has a front portion which is thinner than a rear portion for facilitating digging between said shellfish and said rocks, and said tip is provided with rounded comers and rounded edges for avoiding injuring said shellfish;

wherein when said lamp is activated, light is directed forwards to illuminate said tip of said blade and any shellfish nearby.

6. The diving tool of claim 5, wherein said slot and said blade are tapered toward respective inner ends thereof, and said blade is arranged to be securely wedged inside said handle when fully inserted into said slot.

7. The diving tool of claim 5, further including notches on opposite sides of said inner end of said blade which mate with bumps on opposite sides of said slot to lock in said blade.

8. The diving tool of claim 5, further including a lanyard loop attached to a rear end of said handle.

* * * * *